US007056387B2

(12) United States Patent
van der Steur

(10) Patent No.: US 7,056,387 B2
(45) Date of Patent: Jun. 6, 2006

(54) APPARATUS AND METHOD FOR ELECTROSTATIC SPRAYING OF CONDUCTIVE COATING MATERIALS

(75) Inventor: Gunnar van der Steur, Chesapeake City, MD (US)

(73) Assignee: EFC Systems, Inc., Havre De Grace, MD (US)

( * ) Notice: Subject to any disclaimer, the term of this patent is extended or adjusted under 35 U.S.C. 154(b) by 10 days.

(21) Appl. No.: 10/733,939

(22) Filed: Dec. 10, 2003

(65) Prior Publication Data

US 2005/0129872 A1 Jun. 16, 2005

(51) Int. Cl.
*B05B 5/16* (2006.01)

(52) U.S. Cl. ..... 118/629; 118/627; 239/691

(58) Field of Classification Search ..... 239/690, 239/691, 697, 698, 708, 112, 113; 118/627, 118/629, 630, 631

See application file for complete search history.

(56) References Cited

U.S. PATENT DOCUMENTS 4,779,804 A * 10/1988 Baba et al. ..... 239/690
4,785,760 A 11/1988 Tholome
5,096,126 A * 3/1992 Giroux et al. ..... 239/690
5,310,120 A 5/1994 Ehinger et al.
5,772,125 A * 6/1998 Ehinger et al. ..... 239/694
6,164,561 A * 12/2000 Yoshida et al. ..... 239/223
2002/0007788 A1 1/2002 Nonomura
2002/0117110 A1* 8/2002 Rehman et al. ..... 118/621

* cited by examiner

*Primary Examiner*—George Koch
(74) *Attorney, Agent, or Firm*—E. Alan Uebler, Esq.

(57) ABSTRACT

Apparatus and a method are provided for isolating an electrostatic sprayer from an electrically grounded coating product distribution circuit connected thereto. The apparatus includes an electrostatic sprayer carried by a maneuverable robot arm, the sprayer capable of spraying an electrically conductive coating product such as water-based paint onto a workpiece passing in adjacent proximity thereby, on command. The coating product is supplied from a remote source of supply through at least one distribution circuit connected to the sprayer. The apparatus includes therein, carried by the robot arm, an electrically insulative storage tank for the coating product in valved fluid communication with the sprayer. The insulated storage tank is connected to and positioned downstream from a length of electrically insulative supply conduit connected to the distribution circuit and also carried by the robot arm. This conduit includes a cleaning mechanism for cleaning a portion, including all, of this length of supply conduit, in situ, after filling of the storage tank with coating product and before spraying. In this way, substantially all of the conductive coating product is removed from the portion of supply conduit, thereby completely isolating the sprayer electrically from the distribution circuit.

28 Claims, 7 Drawing Sheets

APPARATUS AND METHOD FOR ELECTROSTATIC SPRAYING OF CONDUCTIVE COATING MATERIALS

FIELD OF THE INVENTION

The invention relates to the electrostatic spray coating of articles generally, and is particularly suited for the spray painting of automotive vehicles with water based paint.

BACKGROUND OF THE INVENTION

In the electrostatic application of paint in the automotive finishing industry, paint may be delivered to a robotically maneuverable atomizer applicator from a plurality of sources, each source providing a different color paint. During application, a high voltage is imposed on the paint, which imparts positive charges on the atomized paint droplets, which are then uniformly attracted to grounded articles being coated, all in known assembly-line fashion. Water based paint is, generally, electrically conductive. Conductivity of the paint composition can create critical safety concerns and hazards in electrostatic operations, wherein the applicator itself must be maintained at a high voltage.

Concomitantly, recently enacted environmental constraints are exerting pressure on the automotive industry to reduce the amount of volatile organic compounds (VOCs) being released into the environment, the majority of which is produced by paint operations. To reduce VOC emissions, painting facilities have gradually been converting from solvent paint carrier systems to water based systems. Water based paint, although much lower in VOC content, creates another set of problems resulting from the electrostatic charges placed on the paint as it leaves the spray atomizer. The charge can travel back down through the electrically conductive paint, acting as a circuit, to ground, thereby presenting a safety concern. The solution is to completely isolate the charged conductive paint being atomized from ground during the painting process.

Several attempts have been undertaken to isolate the high voltage required for electrostatic painting from ground when using conductive, water based paint. One such system to provide galvanic isolation is disclosed in U.S. Pat. No. 4,785,760. This patent describes an electrostatic system for spraying conductive paint wherein a quantity of paint required to paint an object such as a vehicle is stored in a storage tank carried by a multi-axis robot. The spray applicator may be of the rotational, bell cup variety or the pneumatic or hydrostatic spray gun type. The sprayer, carried by the robot, is supplied during painting from a storage tank also mounted on the robot arm and connected to the sprayer. The high voltage generator itself is controllable, that is, its output voltage may be reduced to zero at any time and then re-established virtually instantaneously using conventional controls. See, e.g., the '760 patent at col. 5, line 16 et seq. The high voltage is reduced to zero before a color change cycle is initiated, the storage tank is filled at a local dispensing port, and the voltage is re-established after filling as spraying begins again, resulting in isolation of the high voltage during spraying from the various distribution circuits that are all electrically grounded, because there is no conductive paint conduit connecting them during the spraying operation. ('760, col. 6, lines 57–65).

U.S. Pat. No. 5,310,120 discusses the '760 patent and discloses an alternative storage tank for an electrically conductive liquid coating product. This patent discloses a procedure wherein the coating product, at a high voltage, is carried within a storage tank defined by a substantially cylindrical cavity formed in an insulative material body inside of which is a piston forming a mobile wall separating a coating product chamber from an actuation chamber filled with an electrically insulative actuation fluid. During spraying, because the tank is separated and isolated from the grounded robot carrying it, the electrostatic charge placed on the paint within the storage tank will not track back to ground.

In one further known operation for providing such isolation, an intermediate storage tank is filled with sufficient paint required for one application. Each color change requires that the intermediate tank and the conduits leading to it be cleaned, for example as disclosed in French patent No. 2,572,662. Galvanic isolation is re-established after filling the intermediate tank by draining and drying a sufficient length of conduit upstream of the intermediate storage tank and then commencing painting. This method, however, is said to require a "prohibitive length of time" on each color, and therefore to be "not practical". See, e.g., U.S. Pat. No. 4,785,760, at col. 3, line 25 et seq.

As a point of reference, the '760 patent suggests providing the necessary galvanic isolation by a method involving robotically picking up one small storage tank 22, spraying its contents, and then "hanging it up" locally and getting another one. See, e.g., '760 at col. 7, line 62 et seq.

While such apparatus and procedures may isolate the charged spray paint, they are generally inefficient. Time is of the essence on the paint finish line, an entire vehicle being painted typically in 2–3 minutes. Travel time in these operations in manipulating storage tanks robotically around a paint room is costly. The more time that is spent in emptying, cleaning and color changing, the more costly is the process. It is therefore beneficial to have a system that does not require transporting storage tanks with affixed applicators by means of robot arms to and from paint distributing docking systems, and which can be directly connected to paint supply tanks, all while maintaining complete voltage isolation from ground of the paint being sprayed.

The present invention provides such a system.

SUMMARY OF THE INVENTION

Apparatus and a method are provided for isolating an electrostatic sprayer from an electrically grounded coating product distribution circuit connected thereto. The apparatus includes an electrostatic sprayer carried by a maneuverable robot arm, the sprayer capable of spraying an electrically conductive coating product such as water-based paint onto a workpiece passing in adjacent proximity thereby, on command. The coating product is supplied from a source of supply through at least one distribution circuit connected to the sprayer. The apparatus includes therein, carried by the robot arm, an electrically insulative storage tank for the coating product in valved fluid communication with the sprayer. The insulated storage tank is connected to and positioned downstream in the distribution circuit from a length of electrically insulative supply conduit. The length of supply conduit is connected to the distribution circuit and is also carried by the robot arm. The length of supply conduit includes a cleaning mechanism for cleaning a portion, including all, of the length of supply conduit, in situ, after filling of the storage tank with coating product and before spraying. In this way, substantially all of the conductive coating product is removed from the portion of supply conduit, thereby completely isolating the sprayer electrically from the distribution circuit. The storage tank and supply conduit are preferably formed within a unitary housing made of a non-conductive plastic such as polyacetal resin.

In a preferred embodiment, containment and storage of the coating product prior to spraying are effected within a deformable membrane housed within the storage tank. Spraying is effected by a metering pump positioned downstream of the storage tank and upstream from the sprayer, and preferably the pump is a gear pump.

The membrane can be made of an elastomer, and is preferably a fluoroelastomer such as a fluorinated ethylene propylene (FEP) elastomer or a perfluoroalkyl (PFA) elastomer.

In alternate embodiments, containment and storage of the coating product can be effected within the chamber of a piston-and-cylinder assembly housed within the storage tank prior to spraying or within a balloon-like chamber housed within the storage tank prior to spraying.

Preferably the supply conduit is tubular and the mechanism for cleaning the supply conduit includes a plunger positioned within the conduit and adapted to reciprocally and repeatedly traverse the length of the conduit. The plunger is preferably made of a fluoroelastomer such as FEP.

The apparatus includes driving means for driving the plunger reciprocally back-and-forth through the length of said conduit on command, and the driving means may be air under pressure controlled by valving. In this embodiment, the apparatus has a valve-controlled source of compressed air connected thereto.

To clean the system, the apparatus includes a valve-controlled source of solvent connected within the distribution circuit, and a preferred solvent is deionized water. The apparatus includes a high voltage generator, preferably carried within the apparatus of the invention, the generator being supplied with low voltage via an isolated connector from an external voltage source.

The apparatus may be connected to a plurality of coating product distribution circuits, these circuits optionally distributing coatings of different colors as desired.

A facility for coating a plurality of workpieces simultaneously is contemplated, the installation including a plurality of the apparatus as aforesaid connected to a plurality of coating product distribution circuits. The apparatus is especially suited for coating automotive vehicles.

A process according to the invention is also provided for electrostatically spraying an electrically conductive coating onto a work-piece. The process includes spraying a conductive coating such as water-based paint onto a workpiece passing in adjacent proximity thereto using an electrostatic sprayer carried by a maneuverable robot arm. The batch-operation spraying begins after first supplying the coating to the sprayer system from a source of supply through at least one grounded distribution circuit connected to the sprayer, wherein the distribution circuit includes therein, carried by the robot arm, an electrically insulative storage tank for the coating composition in valved fluid communication with the sprayer and being connected to and positioned downstream from a length of electrically insulative supply conduit. The length of supply conduit is also carried by the robot arm. The process includes cleaning a portion, including all, of the length of the supply conduit, in situ, after filling of the storage tank with coating product and before spraying, thereby removing substantially all of the conductive coating product from the portion of supply conduit within the distribution circuit. This results in isolation of the sprayer electrically from the distribution circuit before actual spraying.

This process of cleaning the supply conduit, using a plunger fitted therein adapted to reciprocally traverse the length of the conduit, effectively wipes it clean of coating product and galvanically isolates the sprayer from the distribution circuit.

DETAILED DESCRIPTION OF THE INVENTION AND PREFERRED EMBODIMENTS WITH REFERENCE TO THE DRAWINGS

Electrostatic spray applicators, as discussed hereinabove, are widely used for spray coating of substrates such as automotive vehicles. Sprayers are typically mounted on and maneuvered by programmable robots in automated production lines. Hydrostatic or pneumatic spray gun applicators or rotary bell cup applicators are typically used to uniformly paint automobiles carried by conveyor to and through a paint booth or area. The time required to actually paint a vehicle typically can range from a few to several minutes. Successive vehicles often must be painted different colors, requiring multiple changing of paint colors at a particular painting station as the production progresses.

Paint supply tanks are generally located remotely from a local painting station, and paint is supplied via distribution lines from these remote storage tanks. In addition, in electrostatic spraying operations using water based, i.e. electrically conductive, paint compositions, which operations involve a high voltage source in implementing uniform coatings, it is imperative that the highly charged spray applicator be galvanically isolated from the grounded paint supply.

In stark contrast to prior techniques for providing such isolation, the present invention provides apparatus and a method for filling, cleaning and electrically isolating a paint storage tank and its associated applicator, in situ, all mounted on the end of a robot controlled arm, and all while maintaining continuous connections to a plurality of paint distribution sources, as needed. According to the invention, there are no multiple connect and disconnect operations of a plurality of storage tanks, or passing of same by robotic arms around a paint room operation, as occurs with certain prior art procedures.

The invention, concisely, provides apparatus and a method for electrically isolating, in situ, a length of the paint feed line leading to a storage compartment for paint to be sprayed onto a workpiece, after filling of the compartment, wherein the compartment and its associated spray applicator are carried by, and maneuvered by, a robot arm.

Figure 1:
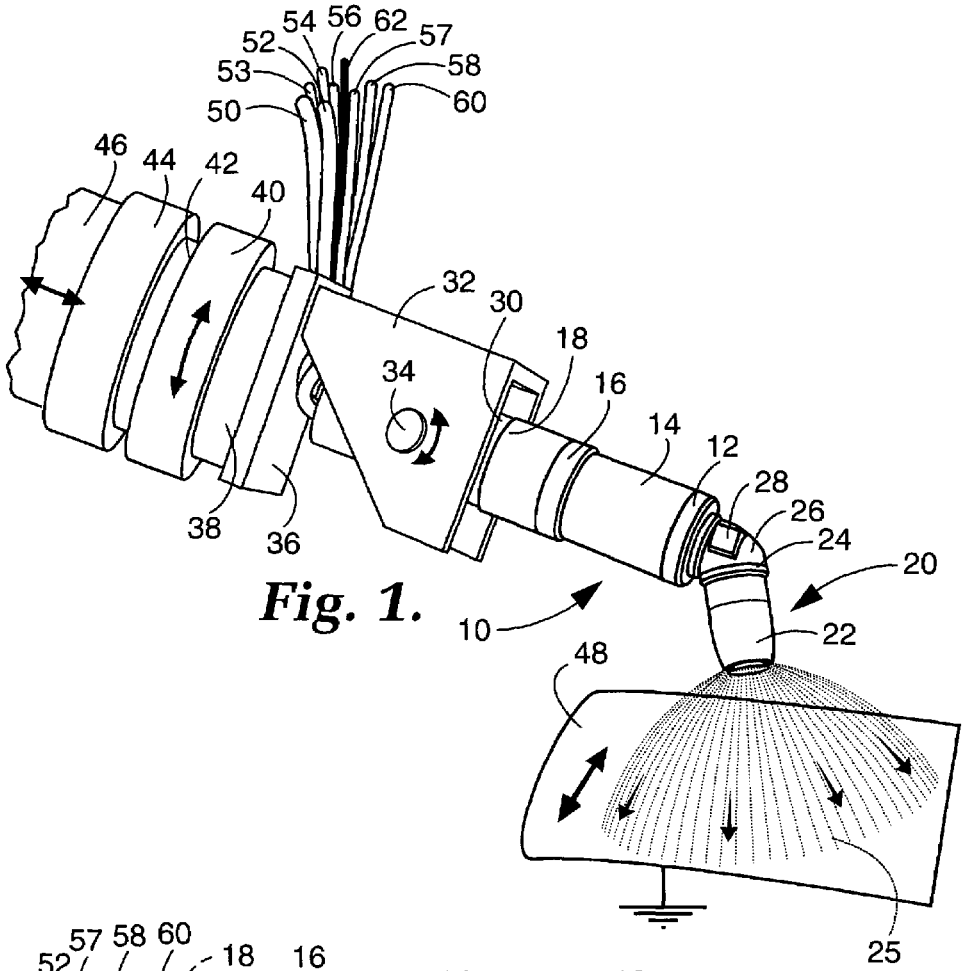
FIG. 1 is an external isometric view of the electrostatic spray coating apparatus of the invention attached to the end of a multi-axially maneuverable robotic arm, showing its housing and all fluid and electrical supply (and discharge) lines.

A detailed description of the invention and preferred embodiments is best provided with reference to the accompanying drawings wherein FIG. 1 is a schematic isometric view of electrostatic paint spraying apparatus according to the invention having a rotary bell cup applicator 20 affixed to the end of a maneuverable robot arm 30 by quick-disconnect nut 16, the applicator applying atomized, electrically charged paint 25 to a workpiece 48. The bell cup spray applicator 20 is affixed to a manifold housing 26 through which is fed the paint and shaping air supplied from inlet paint distribution means 50 and air supply 60. A turbine which drives the rotational bell cup, described below, is housed within housing 22 and is air driven, with air being supplied through air inlet 58. The atomized paint 25 (and shaping air) is discharged from the applicator 20 in a lateral direction, at which point the droplets acquire a charge. Shaping air supplied through hose 60 is routed through the manifold housing 26 and the housing 22 and exits the assembly to help direct the paint 25 over the workpiece 48. The charged paint is then attracted to and deposited on grounded article 48, all as depicted in FIG. 1. The electrostatic field is generated by the electrical source, 62, and the internal voltage potential is maintained at a high voltage, e.g., 80 KV, above ground potential, placing a charge on the particles being emitted from the spray applicator 20 and being deposited as shown onto the grounded substrate 48 to be coated.

FIG. 1 illustrates, schematically, one embodiment of a paint storage chamber 10 carried by the robot arm 30 and affixed thereto by quick-disconnect nut 16, all discussed in detail below. The spray applicator 20 affixed to storage means 10 and connected, as shown, by nut 16 to the robot arm connector 18, is manipulated in three-dimensional space by pivotable housing 32, rotatable as shown by the double headed arrow, about pivot 34, affixed to base plate 36 by extension joint 38, which is rotatable by means of rotating joint 40, indicated by the arrow. Coupling 44 connects this joint to the end 46 of the robot arm, and the arm segment 46 is axially moveable, also as indicated by the arrow shown. For completeness, the bundle of air/paint/solvent supply conduits is shown, including therein the low voltage supply conduit 62, all described more fully below, as well as extension joints 38, 42 and applicator manifold access plate 28.

Figure 2:
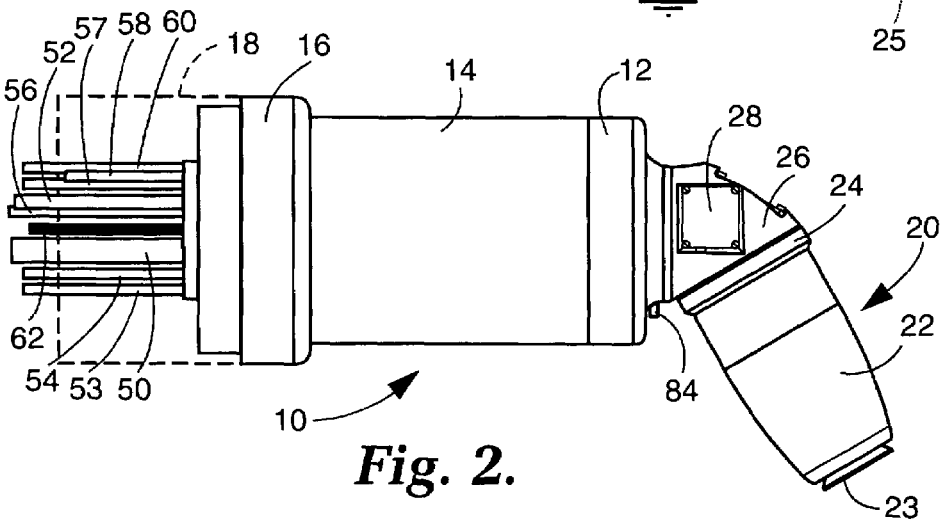
FIG. 2 is a side elevation of the paint applicator and storage chamber of the invention, showing the various supply, return and discharge lines and electric conduit.

FIG. 2 is a side elevation of the storage means 10 and applicator assembly 20, and peripherals, of the embodiment depicted in FIG. 1. Therein, the bundle of supply conduits, including paint supply 50, solvent 52 and air 53 supplies for cleaning operations, air 54 for triggering the various pneumatic valves discussed below, air 56 for adjustment of a storage bladder, air 57 for driving the cleaning plunger, air 58 to power the turbine, air 60 for shaping the paint spray, and the voltage supply conduit 62, are all routed through the robot arm connector 18 (in phantom) and into the storage chamber housing 14. Affixed to the downstream side of the storage chamber assembly 10, by quick disconnect nut 12, is the applicator assembly 20. This assembly includes the manifold housing 26 and bell cup spray applicator assembly 20 affixed thereto by connecting nut 24. The outer shroud 22 and the rotating bell cup 23 of the applicator assembly 20 are visible in this figure as are the removable access plate 28 and the waste discharge tube 84, described more fully below with reference to FIG. 3.

Figure 3:
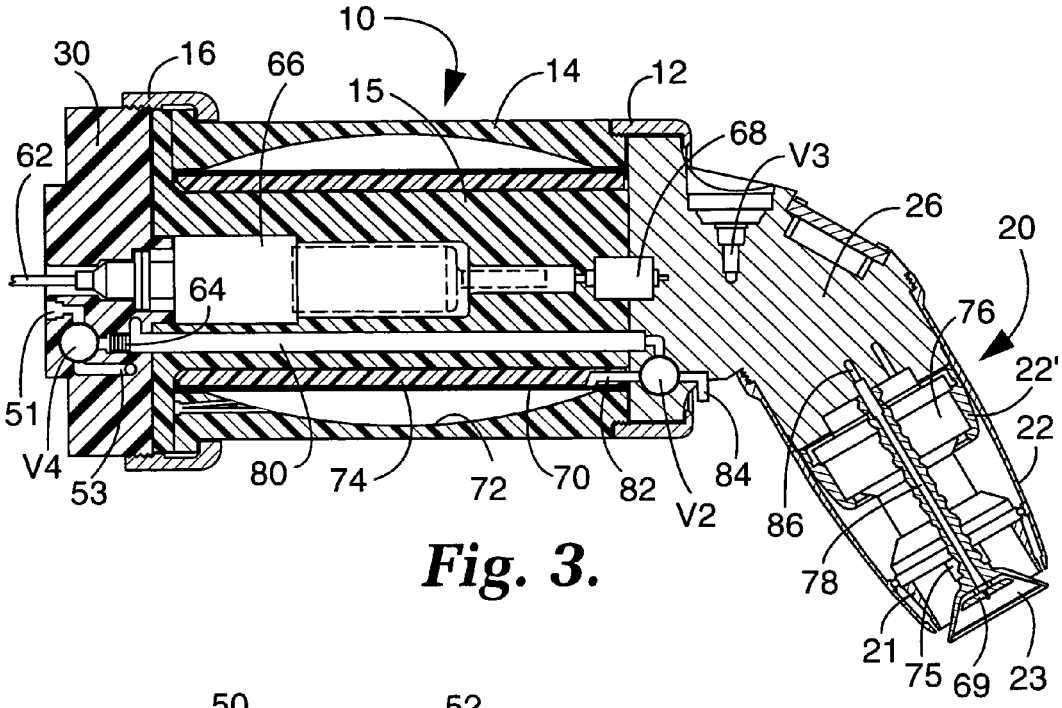
FIG. 3 is a cross-sectional view of the paint applicator and storage chamber of one embodiment of the apparatus of the invention, illustrating certain internal components thereof.

One embodiment of the storage apparatus 10 and rotating bell cup spray applicator assembly 20 of the invention is shown in greater detail in the cross-sectional view of FIG. 3. The applicator assembly 20 includes therein the bell cup body 23, outer shroud 22, inner shroud 21, turbine 76, turbine quick disconnect nut 22' and rotatable deflector 69. The manifold housing 26 has electrostatically insulative internal passages, not shown, through which the coating composition is transported from the stationary, non-rotating coaxial supply channel 50, into the central cavity 86, into stationery paint injection tube 78, and into and out through the annular discharging outlet extending around the outer periphery of deflector 69.

Controlled low voltage (0 to 21 volts, d.c.) is supplied from cable 62. The internal cascade unit 66 steps the voltage up to as much as 100,000 volts. The high voltage is then transmitted through the manifold 26 to the turbine (air bearing motor) 76. The charge is placed on the bell cup assembly by a series of conductive fiber brushes (not shown) which touch the rotating shaft 75 within the turbine 76.

The bell cup body 23 is conventionally affixed to an electrically conductive turbine shaft 75 within the turbine assembly 76. The rotating shaft 75 of the compressed air turbine 76 drives the rotating bell cup assembly, including the body 23 and deflector 69, which expels the atomized paint from the applicator assembly.

Upstream from the applicator 20 is the storage chamber 10, which includes its auxiliary fluid circuitry, all according to the invention. The chamber assembly 10 has affixed to it the applicator assembly 20 by means of quick disconnect nut 12. The chamber 10 is affixed to the robot side base plate 30 by means of quick disconnect nut 16. The storage chamber apparatus 10 in the embodiment shown in FIG. 3 includes outer insulative housing 14 having convex cavity 72 therein. Cavity 72 extends annularly and circumferentially, as shown, around cylindrical sleeve 74 which encircles the central support housing 15 of the storage chamber 10. Sealingly affixed to both ends of sleeve 74 is a bladder 70. A valved (V2) channel 82 formed in sleeve 74 provides fluid communication between paint supply inlet 50, through the paint fill line 80, and thence, valved, into the gap between the bladder 70 and the sleeve 74 when the valve V2 is opened appropriately, resulting in the filling of and storage of paint within the bladder 70 contained by the walls of the convex cavity 72.

The storage tank housing 14, the sleeve 74 and the central support housing 15 are all made of an electrically insulative plastic material, preferably a polyacetal resin sold under the trademark DELRIN®. The bladder 70 is preferably of an elastomer, preferably a synthetic fluoroelastomer. Especially preferred is a membrane of fluorinated ethylene propylene (FEP) elastomer.

Formed within the central housing 15 is the paint fill line 80 preferably extending from an upstream valved (V1) inlet 50 through the central housing 15 to a valved (V2) outlet line 82. Upon command, paint enters through the paint fill line 80 from supply conduit 50, proceeds through line 82 to fill the bladder 70, at which point the supply is shut off.

From this stage of operation on, with the filled bladder 70 intact, the paint fill line 80 may be cleaned of all conductive paint, and dried, all as described below, thereby electrically isolating the stored paint in the bladder 70 and the applicator assembly 20 from the rest of apparatus. After such cleaning, and with the opening of valve V3, the painting operation proceeds, preferably by means of a metered gear pump (not seen) drawing paint from the storage bladder 70 and expelling it outwardly through the rotary bell cup applicator 20, all in complete electrical isolation from ground.

Before describing in detail the sequence of operative steps of filling the storage bladder 70, cleaning the fill line 80 to galvanically isolate the system, painting, flushing and refilling before a second painting operation, reference is redirected to FIG. 3 to illustrate a preferred mechanism for cleaning and drying the fill conduit 80 after the bladder 70 is filled. Positioned relatively snugly, and fluid sealingly, within fill tube 80 is plunger 64, preferably also made of a fluoroelastomer as discussed. The plunger 64 is reciprocally driveable, back and forth through fill tube 80, its direction of traverse being controlled by air and appropriate valving (V4 and V5, V5 not seen in this figure) positioned at either end of fill tube 80. Thus, with V4 (see FIG. 4 also) open to air line 53 and V2 open to discharge line 84 only, air drives the plunger 64 from the leftmost location of tube 80 in FIG. 3 to the rightmost location. In so doing, the plunger 64 acts as a squeegee and forces residual paint out of the fill tube 80 and to discharge through discharge tube 84 to waste. Reversing this operation returns the plunger 64 to its leftmost location. A controlled series of such operations is clearly contemplated and described in detail hereinbelow.

In FIG. 3, the electrical cascade 66 and electrical conduits 68, housed within the central support housing 15, and the low voltage supply conduit 62 are all shown for completeness. Omitted from FIG. 3, and not seen in this view, is the pathway of the paint line 86 from its entry into applicator 20 (shown) and backwardly to and through its pumping means and further upstream into the bladder 70 storage volume (shown schematically in FIGS. 4 and 5). One skilled in the art will understand this channeling with reference to FIGS. 4–16 hereinbelow.

The schematic diagrams of FIGS. 4–7 and FIGS. 8–16 all serve to illustrate the various key components of the invention and their respective functions. In FIGS. 4–7, the diagrams show the fill tube 80 and its adjacent peripherals and only the lower diagrammatic portion of the storage bladder 70, it being understood that the cavity 72 defined by the outer housing 14 and the inner sleeve 74, with bladder 70 affixed thereto at either end, extends circumferentially around the central support housing 15. These figures are to be viewed together with FIG. 3.

Figure 4:
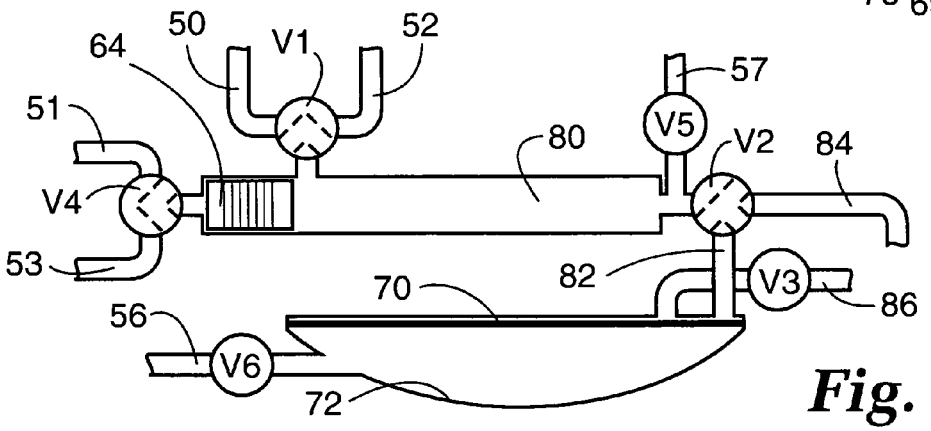
FIGS. 4–7 illustrate, schematically, fluid conduits and valving employed in the preferred apparatus of the invention.

At the beginning of a paint cycle, with the entire system clean, with reference to FIG. 4, the plunger 64 is positioned at its leftmost rest position. Valves V4 and V2 are closed as shown, as are valves V1, V3 and V5 (air line). Valve V6 is closed, and this represents the sealed rest position for a clean system.

Figure 5:
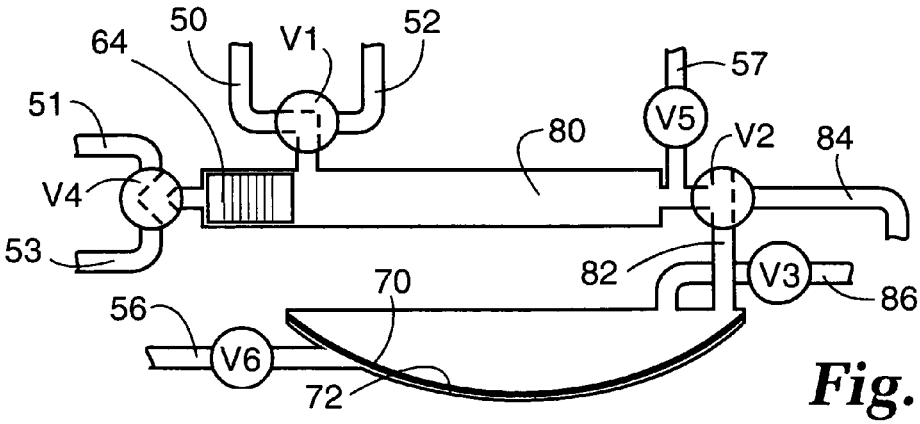

When painting is desired, referring to FIG. 5, valve V6 is opened to atmosphere and valve V2 is opened as shown to allow passage from the fill tube 80 into the bladder storage volume. Opening valve V1 as shown then allows paint to enter fill line 80 from paint line 50, proceed through the tube 80 through conduit 82 and into the space between the sleeve 74 (FIG. 3) and the bladder 70, filling it as shown in FIG. 5. The valving may be controlled by pneumatic signals by known techniques. As paint enters, the bladder 70 expands until it is filled to capacity, which is determined by flow rate and fill time, at which point valves V1, V2 and V6 are closed.

Figure 5A:
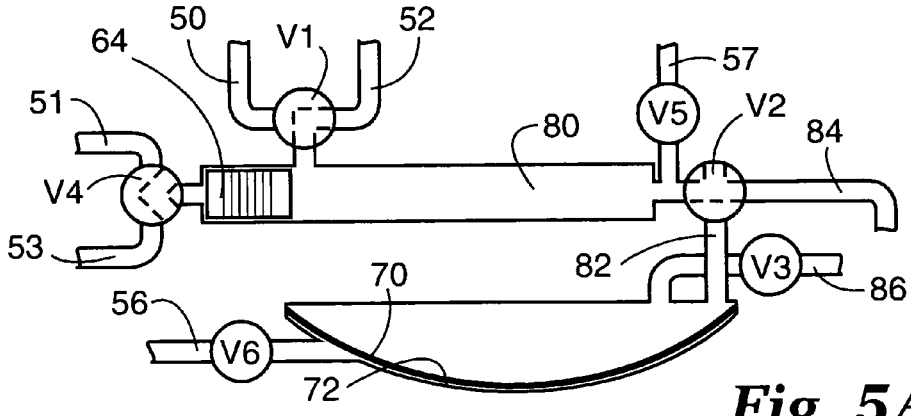
Figure 6:
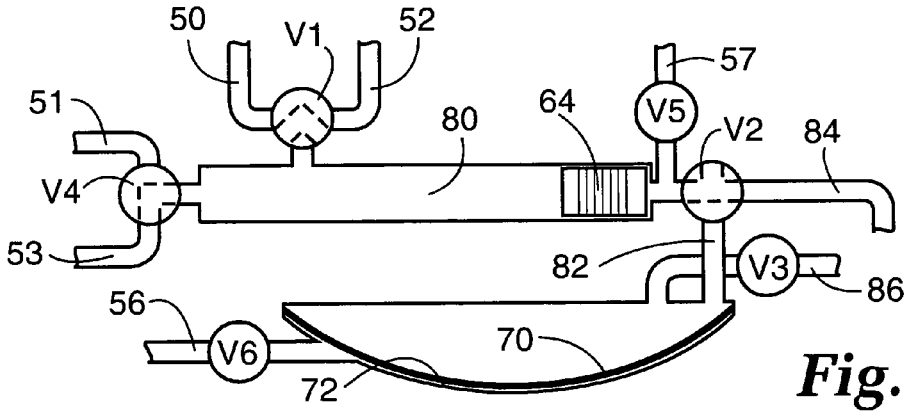
Figure 7:
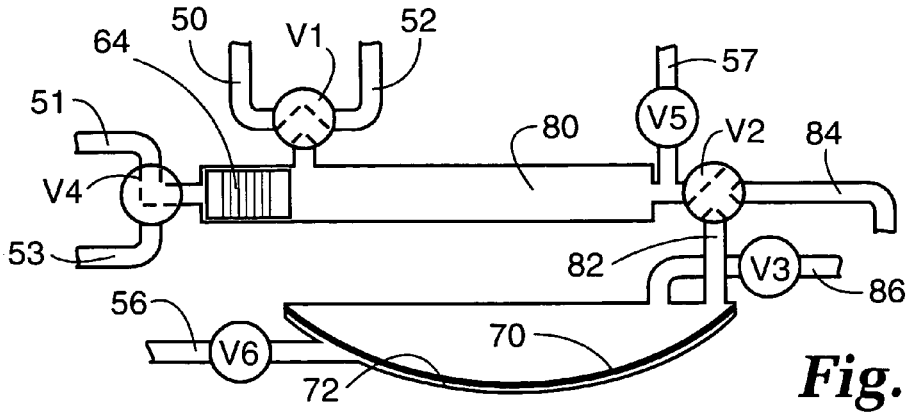

With reference to FIGS. 5, 5A and 6, in order to safely apply paint to the workpiece electrostatically, at least a portion of the conductive paint path from the grounded paint distribution line 50 to the storage bladder 70 can be interrupted, such as by cleaning all residual paint out of the fill line 80 and drying this line, prior to spray painting. To accomplish this, referring to FIG. 5A, solvent (water) is injected into the system by opening V1 to solvent supply line 52 to allow solvent to pass into and through tube 80, then to and through discharge line 84 (valve V2 being opened), to flush out tube 80 and clean it. Valve V1 is closed and then, as shown in FIG. 6, valve V4 may be opened to air line 53, driving the plunger 64 to its rightmost position, cleaning the walls of tube 80 by a squeegee action and forcing all excess solvent and residual paint out to waste through line 84. To return the plunger 64 to its starting position, a pneumatic signal triggers valve V5 to open to air line 57 and V2 is closed, while valve V4 is opened to exhaust 51, thus driving the plunger 64 back to its start position, as shown in FIG. 7. This sequence of flushing with solvent and returning plunger 64 to its start position may be repeated as necessary. Air is finally purged through the system to dry it, by opening V4 to air line 53 and V2 to discharge 84 and thereby remove any conductive pathway between paint line 50 and the paint within the storage bladder 70. Paint is then applied to the workpiece through paint line 86 with V3 open, V6 open to atmosphere, and all other valves closed.

It will be appreciated that alternative valving schemes may be employed to provide the fill-flush-dry operation according to the invention. The above is one example of such sequence.

Figure 8:
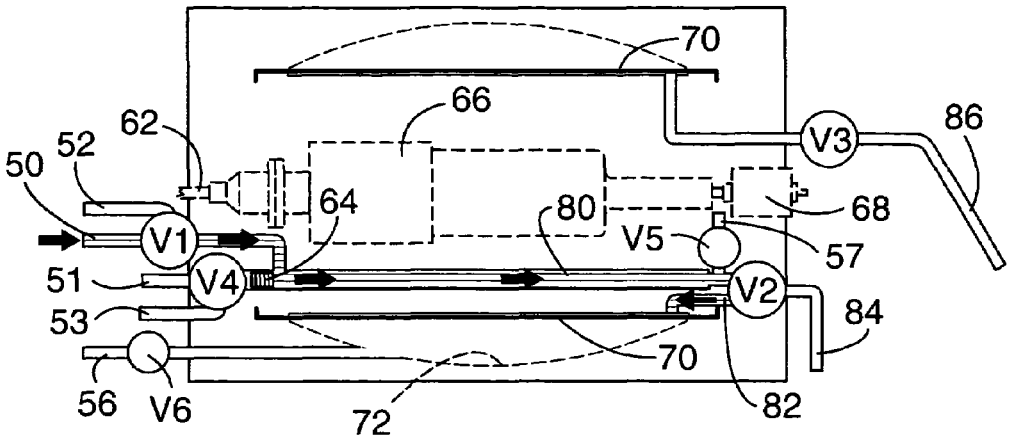
FIGS. 8–12 illustrate schematically a sequence of steps to be encountered in the filling and electrically isolating from ground the storage chamber and spray applicator, and the spray operation, according to the invention.

FIGS. 8–16 illustrate, in somewhat more detail, nonetheless schematically, the various steps in the process according to the invention. FIG. 8 illustrates an initial filling step. Therein, V1 is open to paint line 50, V6 is open to atmosphere, and V2 is set as in FIG. 5 to connect tube 80 with the bladder fill opening 82. Valves V3, V4 and V5 are closed. Paint, indicated by the solid arrow and the shading, enters from distribution line 50 and begins to fill bladder 70.

Figure 9:
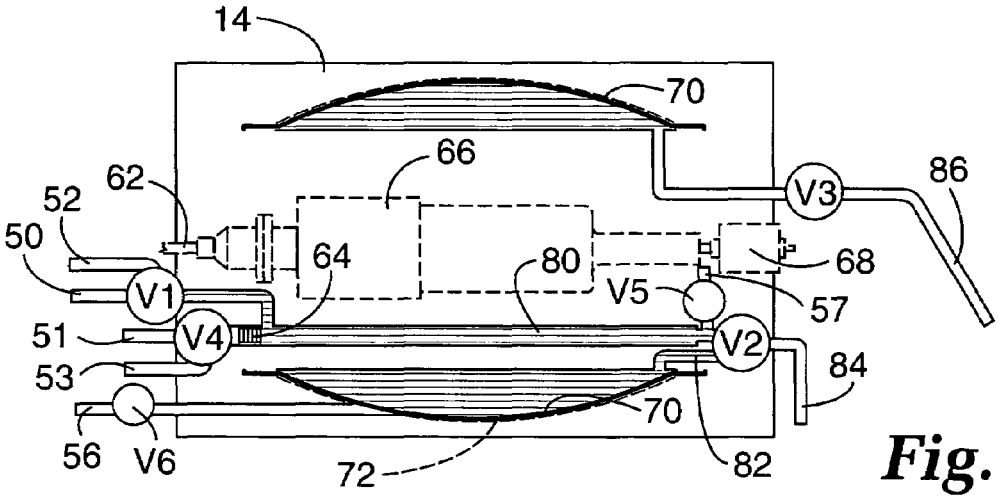

FIG. 9 shows the filled bladder 70 and filled tube 80, at which point V1, V2 and V6 are closed.

Figure 10:
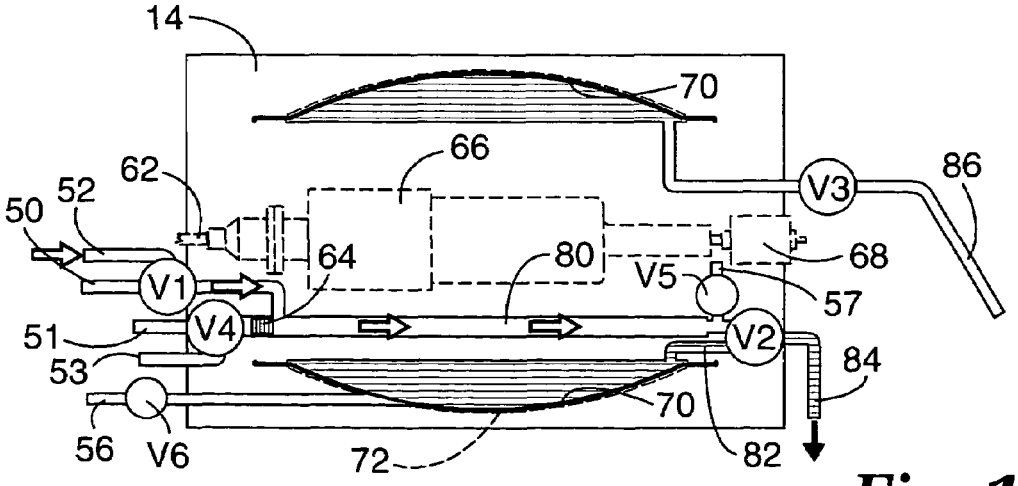

FIG. 10 illustrates the opening of valve V1 to line 52 to introduce solvent (water), indicated by the open (non-shaded) arrows into the fill line 80, thereby flushing tube 80 with water and cleaning it of residual paint. In this figure, valves V3, V5 and V6 are closed, and V2 is adjusted to send the flushing components and residual paint to waste through tube 84. See FIG. 5A.

Figure 11:
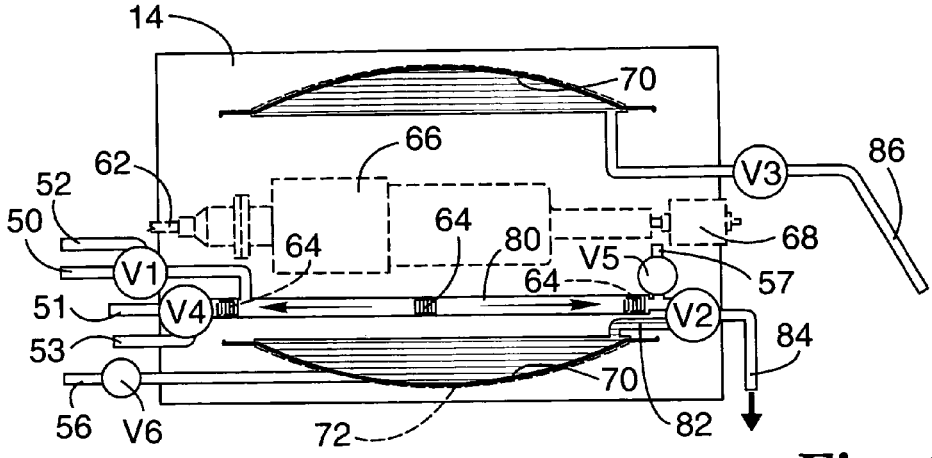

By successively and alternatively opening and closing V4 and V5 to air, with V2 opened to waste and V4 opened to exhaust, as needed, and V1, V3 and V6 closed, all as illustrated in FIG. 11, the plunger 64 may be caused to reciprocally traverse the tube 80 as indicated by the arrows, driven therethrough by air. The leftmost and rightmost positions of plunger 64 in this operation are shown in phantom. Flushing may be repeated as necessary, all to completely flush, clean and dry tube 80.

Figure 12:
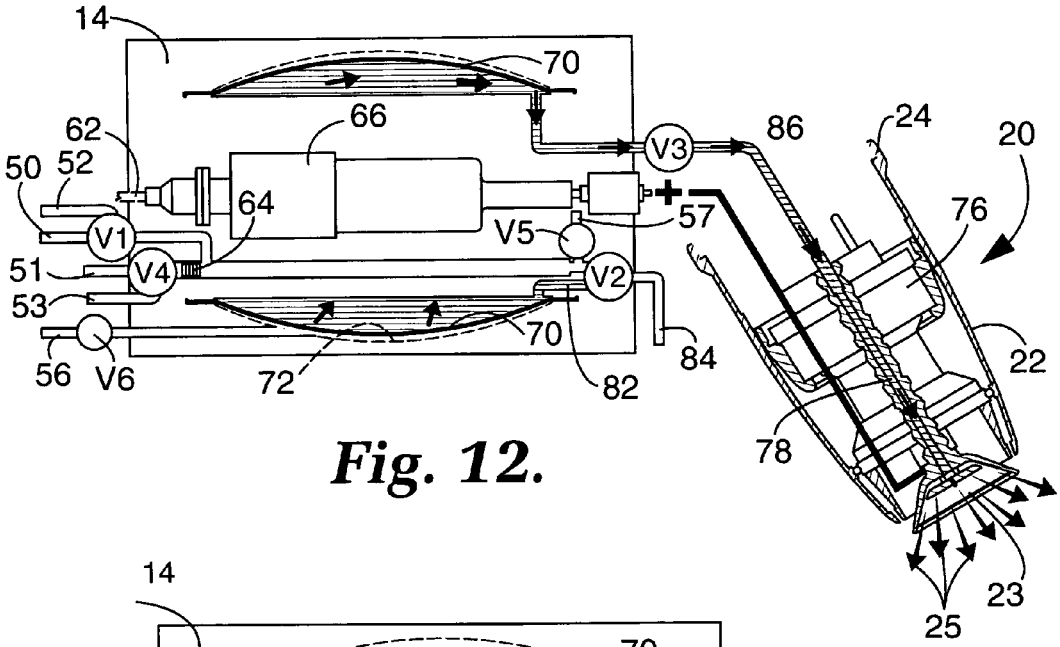

Painting begins at FIG. 12. Therein, valves V1, V2, V4 and V5 are closed. V3 is open, as is V6 (to atmosphere). Voltage is applied and paint 25 is drawn from the bladder 70 by a metering pump and is atomized and sprayed by means of rotary bell cup applicator 20.

Figure 13:
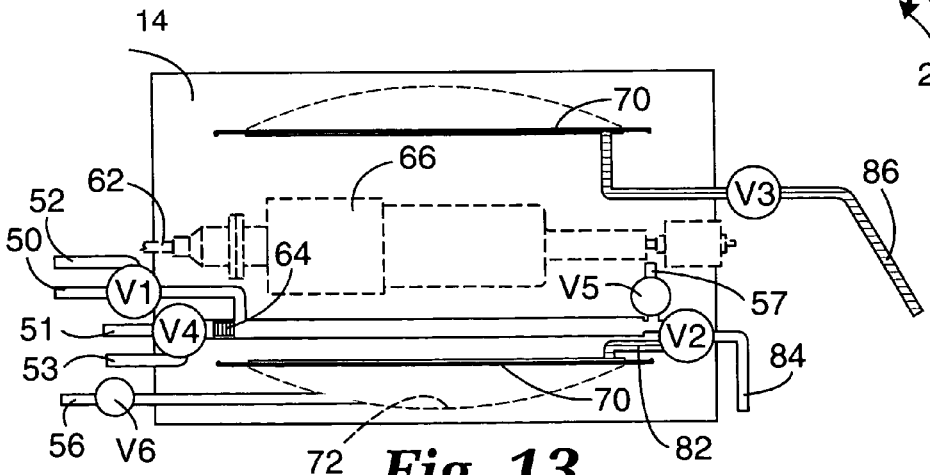
FIGS. 13–16 illustrate schematically a sequence of steps encountered in the cleaning and preparing of the storage chamber and spray applicator according to the invention for a new spray cycle.
Figure 14:
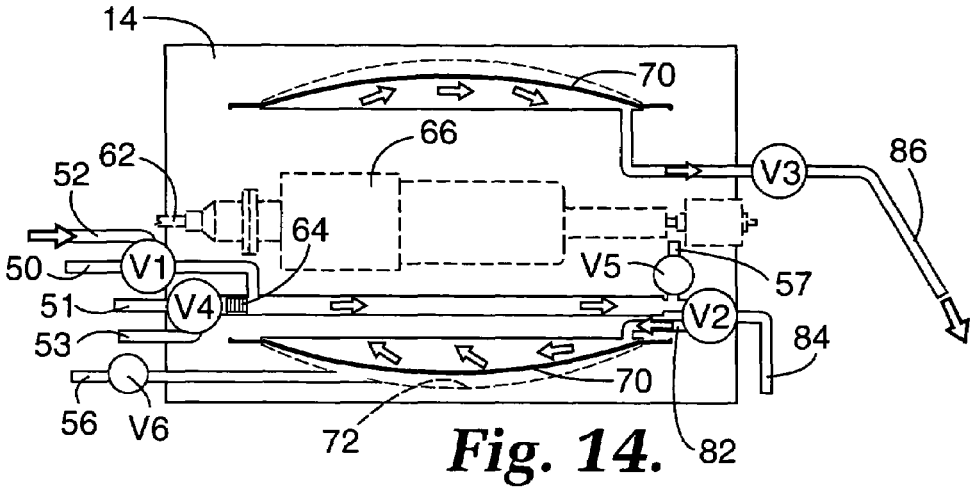
Figure 15:
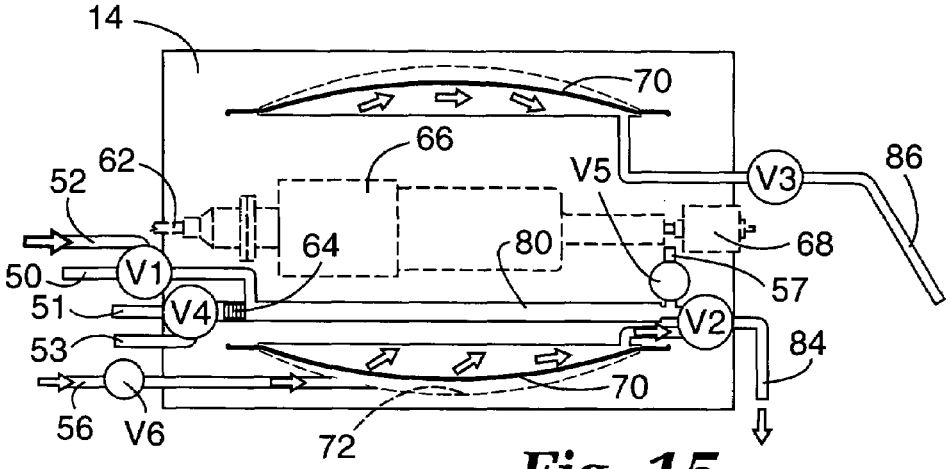
Figure 16:
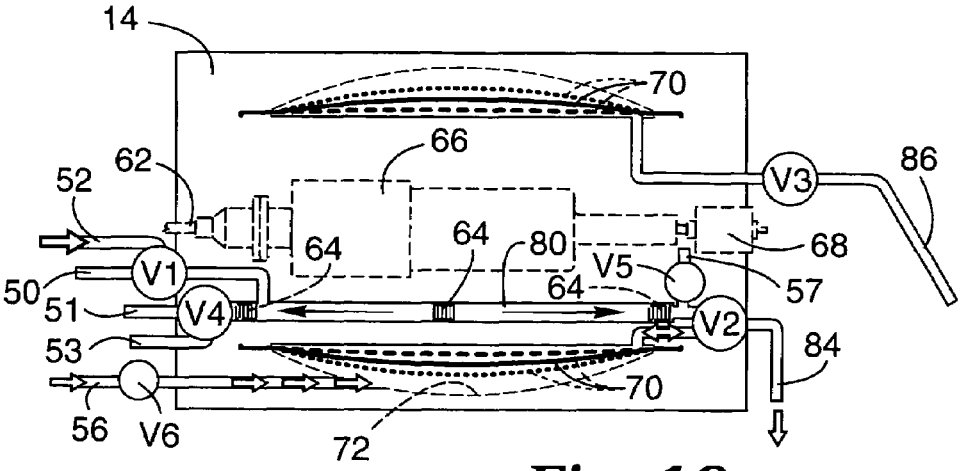

FIG. 13 illustrates the completion of the paint cycle and the depletion of paint within bladder 70. At this point, the system can be flushed with solvent as shown in FIG. 14, leaving V3 open, opening V2 to waste, and introducing solvent/water into the system indicated by open (non-shaded) arrows through supply line 52. Also, opening V2 as shown in FIG. 5 will permit the solvent to flush out the bladder. As shown in FIG. 15, closing V3 and opening V2 to connect the bladder interior to both tube 80 and discharge 84 and opening V6 to allow pressurized air, indicated by the smaller open arrows as shown, to compress the bladder 70 externally, would also aid in flushing the bladder. As illustrated by the several dashed lines 70 in FIG. 16, this operation may be repeated, causing the bladder to vibrate radially and rapidly, to help ensure that the bladder is completely cleaned of residual paint. The plunger 64 may be reciprocally driven back and forth through tube 80, as needed, by opening and closing air valves V4 and V5, to wipe tube 80 free of residual liquid, as illustrated in FIG. 16.

After the storage bladder is completely flushed with solvent, air may be introduced into the system to dry the entire system, including the bladder. The paint fill cycle may then be repeated, with reference back to FIG. 8.

Figure 17:
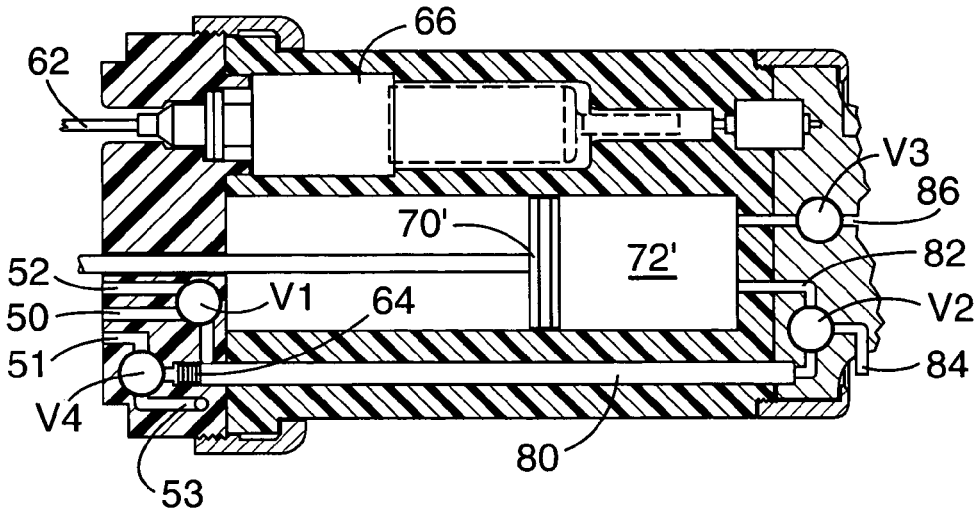
FIG. 17 is a schematic illustration of a piston- and cylinder type of storage chamber in an alternate embodiment of the invention.

FIG. 17 is a simplified schematic diagram showing a possible configuration for piston-and-cylinder storage means 70', 72' instead of a bladder, wherein like numbers designate like components in all figures.

Figure 18:
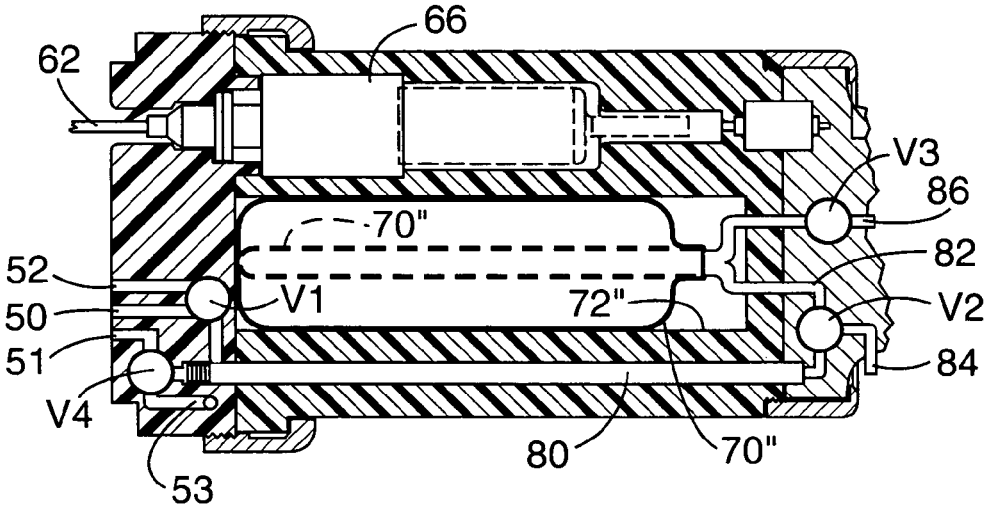
FIG. 18 is a schematic illustration of a balloon-type of storage chamber in a further alternate embodiment of the invention.

FIG. 18 is a simplified schematic diagram showing a possible configuration for a balloon storage means 70" instead of a bladder, wherein an empty balloon 70" is shown in phantom and the filled balloon 70" is shown filling the chamber 72", in a procedure similar to that employed with bladder 70.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus for isolating an electrostatic sprayer from an electrically grounded coating product distribution circuit connected thereto, the apparatus comprising:

an electrostatic sprayer carried by a maneuverable robot arm, the sprayer capable of spraying an electrically conductive coating product onto a workpiece passing in adjacent proximity thereby on command, said coating product being supplied from a source of supply through at least one distribution circuit connected to said sprayer, said distribution circuit including therein, and carried by said robot arm, an electrically insulative storage tank for said coating product in valved fluid communication with said sprayer and connected to and positioned downstream from a length of electrically insulative supply conduit, said length of supply conduit also carried by said robot arm and including means for cleaning a portion, including all, of said length of supply conduit, in situ, after filling of said storage tank with coating product and before spraying, such that substantially all of said conductive coating product is removed from said portion of supply conduit, thereby isolating said sprayer electrically from said distribution circuit, wherein containment and storage of said coating product prior to spraying are effected within a deformable membrane housed within said storage tank.

2. The apparatus of claim 1 wherein said storage tank and supply conduit are formed within a unitary housing.

3. The apparatus of claim 1 wherein said supply conduit is formed of polyacetal resin.

4. The apparatus of claim 2 wherein said housing is formed of polyacetal resin.

5. The apparatus of claim 1 wherein spraying is effected by metered pump means positioned downstream of said storage tank and upstream from said sprayer.

6. The apparatus of claim 5 wherein said pump means is a gear pump.

7. The apparatus of claim 1 wherein said membrane is made of an elastomer.

8. The apparatus of claim 7 wherein said elastomer is a fluoroelastomer.

9. The apparatus of claim 8 wherein said elastomer is a fluorinated ethylene propylene (FEP) elastomer.

10. The apparatus of claim 8 wherein said elastomer is a perfluoroalkyl (PFA) elastomer.

11. The apparatus of claim 1 wherein said deformable membrane is a balloon-like chamber housed within said storage tank prior to spraying.

12. The apparatus of claim 1 wherein said supply conduit is tubular.

13. The apparatus of claim 12 wherein said means for cleaning said supply conduit includes a plunger positioned within said conduit and adapted to reciprocally traverse said length of said conduit.

14. The apparatus of claim 13 wherein said plunger is made of a fluoroelastomer.

15. The apparatus of claim 13 including driving means for driving said plunger reciprocally back-and-forth through said length of said conduit on command.

16. The apparatus of claim 15 wherein said driving means comprises air under pressure controlled by valving.

17. The apparatus of claim 16 having a valve-controlled source of compressed air connected thereto.

18. The apparatus of claim 1 including a valve-controlled source of solvent connected to said distribution circuit.

19. The apparatus of claim 18 wherein said solvent is water.

20. The apparatus of claim 19 wherein said solvent is de-ionized water.

21. The apparatus of claim 1 including a high voltage generator carried within said robot arm, said generator being supplied with low voltage via an isolated connector from an external voltage source.

22. The apparatus of claim 1 connected to a plurality of coating product distribution circuits, said circuits optionally distributing coatings of different colors.

23. The apparatus of claim 1 connected to a source of water-based paint.

24. An installation for coating a plurality of work-pieces simultaneously, said installation including a plurality of the apparatus of claim 1 connected to a plurality of coating product distribution circuits.

25. The apparatus of claim 1 wherein said work-piece is an automotive vehicle.

26. The apparatus of claim 24 wherein said work-pieces are automotive vehicles.

27. Apparatus for isolating an electrostatic sprayer from an electrically grounded, water-based paint distribution circuit connected thereto, the apparatus comprising:

an electrostatic spray applicator carried by a maneuverable robot arm, the applicator capable of spraying water-based paint onto an automotive vehicle passing in adjacent proximity thereby on command, said paint being supplied from a paint source through at least one grounded distribution circuit connected to said applicator, said distribution circuit including therein, and carried by said robot arm, an electrically insulative storage tank for said paint in valved fluid communication with said applicator and connected to and positioned downstream from a length of electrically insulative supply conduit, said length of supply conduit also being carried by the robot arm and including plunger means for cleaning a portion, including all, of said length of supply conduit, in situ, after filling of said storage tank with water-based paint and before spraying, such that substantially all of said conductive paint is removed from said portion of supply conduit, thereby isolating said applicator from said distribution circuit, wherein said storage tank and supply conduit are formed within a unitary housing, all made of polyacetal resin, and containment and storage of the paint prior to spraying is effected within a deformable membrane of a fluorinated ethylene propylene (FEP) elastomer, and said supply conduit is tubular having a plunger of a fluoroelastomer positioned therein and adapted to reciprocally traverse said length of said conduit, and including a valve-controlled source of compressed air connected thereto providing valve-controlled driving means for driving said plunger reciprocally back-and-forth through said conduit on command.

28. An installation for painting a plurality of automotive vehicles simultaneously, including a plurality of the apparatus of claim 27 connected to a plurality of water-based paint distribution circuits.

* * * * *